United States Patent [19]

Heimreid et al.

[11] Patent Number: 4,893,367

[45] Date of Patent: Jan. 16, 1990

[54] SYSTEM OF SEPARATELY ADJUSTABLE PILLOWS

[76] Inventors: Bent Heimreid, Ovre Maihaugen 4B, N-3700 Skien; Finn Risung, Borgekroken 31, 3900 Porsgrunn, both of Norway

[21] Appl. No.: 297,427

[22] Filed: Jan. 17, 1989

[30] Foreign Application Priority Data

Jan. 18, 1988 [NO] Norway ..... 880185

[51] Int. Cl.[4] ..... A47C 27/10

[52] U.S. Cl. ..... 5/431; 5/453; 5/454; 5/456

[58] Field of Search ..... 5/453, 454, 455, 456, 5/441, 431; 297/DIG. 3

[56] References Cited

U.S. PATENT DOCUMENTS

| | | | |
|---|---|---|---|
| 595,734 | 12/1897 | Rand et al. | 5/455 |
| 3,330,598 | 7/1967 | Whiteside | 297/DIG. 3 |
| 3,900,910 | 8/1975 | Nakata | 5/441 |
| 4,142,263 | 3/1979 | Pierson | 5/441 |
| 4,190,286 | 2/1980 | Bentley | 5/454 |
| 4,685,163 | 8/1987 | Quillen et al. | 5/431 |

FOREIGN PATENT DOCUMENTS

| | | | |
|---|---|---|---|
| 20122666 | 10/1984 | European Pat. Off. . | |
| 20235967 | 9/1987 | European Pat. Off. . | |
| 918109 | 9/1954 | Fed. Rep. of Germany . | |
| 1012737 | 7/1957 | Fed. Rep. of Germany . | |
| 3205859 | 10/1982 | Fed. Rep. of Germany | 297/DIG. 3 |
| 129279 | 7/1974 | Norway . | |
| 28375 | 12/1910 | United Kingdom | 5/454 |
| 1474018 | 5/1977 | United Kingdom . | |
| 1534821 | 12/1978 | United Kingdom . | |
| 1545806 | 5/1979 | United Kingdom . | |
| 1601682 | 11/1981 | United Kingdom . | |
| 1602952 | 11/1981 | United Kingdom . | |
| 2105984 | 4/1983 | United Kingdom | 5/455 |
| 2134382 | 8/1984 | United Kingdom . | |
| 2168893 | 7/1986 | United Kingdom . | |
| 2169195 | 7/1986 | United Kingdom . | |

*Primary Examiner*—Alexander Grosz

*Attorney, Agent, or Firm*—Cushman, Darby, Cushman

[57] ABSTRACT

A system of separately adjustable pillows is characterized by a plurality of separately inflatable and deflatable containers which may be emptied or filled from a connected source with a pressurized fluid, via a manifold which is provided with valves for each container.

1 Claim, 1 Drawing Sheet

SYSTEM OF SEPARATELY ADJUSTABLE PILLOWS

BACKGROUND OF THE INVENTION

The present invention relates to a system of separately adjustable pillows, so that by the aid of one or a plurality of independently adjustable pillows it will be possible to achieve correct positions of the human body when certain functions or certain tasks are carried out.

To persons who have to lie for a long time in special or uncomfortable positions due to physical disablement or illness, or because they must undergo medical treatment, the market offers poor assistance to enable individual adaption of the supporting bedding. As a rule arbitrary sand bags or pillows of foamed plastic with non-adapted dimensions must be used.

In case of hospital treatment, long-term treatment in an institution, as well as in cases of community nursing light-weight and mobile equipment of this kind is not available to support patients while they receive care or treatment by medical staff.

As regards known technology, we make reference to DE-AS 10 12 737 disclosing an air mattress of a kind known per se, but with the air tube means constituting the lateral edges and a foot member being raisable above the horizontal plane to be connected into a bed-like structure.

We also refer to DE-PS 918109 disclosing a mattress the central inflatable panels of which may be turned up 90° above the outer inflatable panels, and where inflatable pillows may, if desired, be placed between the walls thus provided.

Furthermore, we refer to NO-PS 129 279, disclosing a mattress which is divided into panels by the aid of transverse and longitudinal seams, and where lateral panels and end panels may be raised to form a bed when air is made to escape from panels provided at the corners.

SUMMARY OF THE INVENTION

It is an object of the present invention to eliminate the drawbacks of known technology, the invention aiming at providing a lightweight, flexible, and mobile equipment that may both ease the pain of the patients and simplify work for doctors, technicians, and nurses in cases of ordinary nursing and treatment, as well as in connection with medical examinations, and surgery.

It is an object of the invention that patients should be able to adjust the system of pillows according to their own desires and requirements.

The invention may also be utilized outside a bed, operating table, or an examination/treatment couch, e.g. on stretchers, or in an invalid chair, and/or in connection with other medical technical equipment.

The invention is, however, not limited to such usage, but may in principle be successfully utilized, e.g. in connection with common furniture, in connection with conventional vehicles and construction machinery, since the invention permits achievement of quite individually correct sitting and reclining positions.

The invention shall, however, mainly be disclosed with reference to health service.

DETAILED DESCRIPTION

Figure 1:
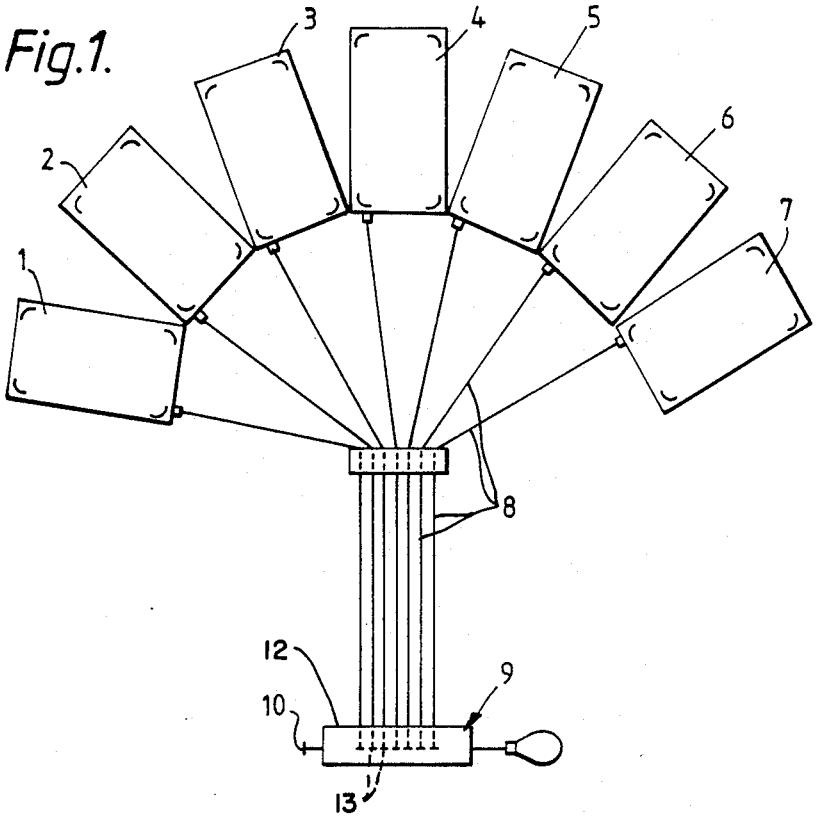
FIG. 1 shows a top plan view of a system of separately adjustable pillows provided in accordance with principles of the present invention.
Figure 2:
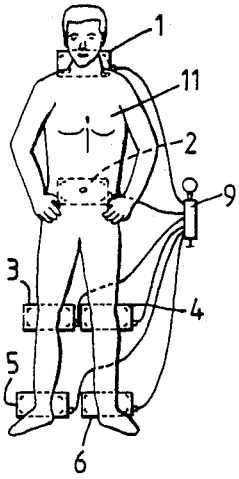
FIG. 2 shows a top plan view thereof, on a smaller scale, in use.
Figure 3:
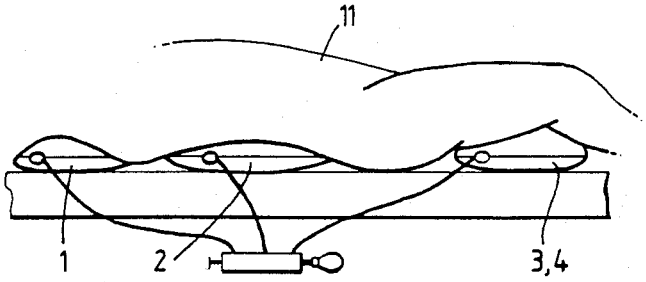
FIG. 3 is a fragmentary side elevation view of the pillow system in use.

The invention relates to a system of separately adjustable pillows which is characterized by a plurality of inflatable and deflatable containers which, via a manifold provided with valves for each container, may be deflated or inflated from a connected source of a pressurized fluid.

A preferred pressurized fluid is air which will protect against loss of heat, and a preferred material of the containers is a suitable material with high friction in contact with textiles. Certain plastic materials would be well suited due to toughness, resiliency, strength, and an "adhering" surface which will, thus, stabilize the arrangement of the pillows. The pillows may also be provided with special fastening means, e.g. Velcro ® hook and fleece-type fasteners, buttons, or straps, for fixing the pollows in special positions.

A surgeon carrying out examinations or surgical intervention will often want parts of the patient's body 11 to be raised or lowered in order to relieve certain tensions or to achieve easy access to the organs to be treated.

The present invention will render this possible, the system of pillows comprising a plurality of freely movable, and mutually independent pillows 1, 2, 3, 4, 5, 6, 7, which may, e.g. in advance, in an empty state, be placed at any desired location beneath or around the patient.

Then the pillows may be inflated or adjusted to the desired degree of inflation at any time.

Only a small volume of fluid will be required to achieve the desired effect, and such a volume may readily be supplied, e.g. by the aid of a small hand pump or a "spray box".

With a low volume of fluid, the system of pillows will distribute the pressure against the patient's body over a very large surface and, thus, highly contribute to relieve sore points, and improve local circulation.

By the aid of a slightly higher degree of inflation, it will be possible to achieve a larger degree of raising, thus, to change the position of the patient.

The pillows may also be arranged in combinations, if desired, with a stiffening plate in between, so that the lowermost pillow may be raised to a high level, whereas the uppermost and less inflated pillow will remain soft and distribute pressure.

The system of pillows is readily penetrated by X-rays, and it will not interfere with such examination.

The system according to the invention is simple and hygienic, it can readily be cleaned and maintained, it is simple in production and operation, and may readily be moved, also it may be adapted without any difficulties to any technical equipment available today.

Adjustment of the pillows may readily be done, even during surgery, without interference with sterility or safety measures in connection with surgery. When the pillows are placed in advance, in an empty state, adjustment may occur without heavy and difficult lifting operations to strain the backs of the staff.

The number of pillows may be selected freely depending on the current situation, and five to seven pillows will commonly cover most requirements. The size and shape of the pillows may vary, but a rectangular pillow of 30×50 cm will commonly be suitable.

Each pillow is connected, via an inflation tube 8 with a suitable valve system 9, with a source 10 of pressurized fluid, preferably a pump, generally a hand pump, or another suitable source of pressurized fluid. The valve system 9 includes a manifold 12 with a separate valve 13 for each pillow inflation tube 8.

One or a plurality of pillows can, in a simple manner, be inflated or deflated according to requirement, thus, to provide the correct position of the patient. If desired from consideration of the patient, e.g. for cooling or warming the patient, it is obviously possible to use cold or hot liquid instead of compressed air.

In this connection, the pillows may also be provided anywhere beneath, around, and on top of the patient.

The manifolds may also be designed so as to permit continuous passage of liquid through the pillows.

Utilization of the system of pillows was thoroughly tested in practice and brought considerable relief from pain to patients in uncomfortable positions, and it resulted in a clearly reduced demand for pain-killers.

Especially in treatment of unconcious or paralysed patients, the system of pillows will relieve and prevent injures due to pressure, as well as insulate and prevent loss of heat.

Patients who are awake may have their position or pressure relief adjusted, either by summoning staff, or, if possible, by carrying out adjustments themselves.

The invention is, however, not limited to utilization in public health service, as mentioned above. Such a system may very well be incorporated in seats for working, e.g. in cars, construction machinery or the like.

Having described out invention, we claim:

1. A system of separately adjustable pillows, comprising:

a plurality of inflatable pillows, each of which is subject to being moved about in relation to a person's body substantially independently of all others of said pillows;

each pillow being subject to being inflated with a fluid to a desired extent, having, when less inflated, a smaller volume and a softer feel and having, when more inflated, a larger volume and a harder feel; and a means for inflating each pillow, comprising:

a manifold for receiving a supply of pressurized fluid;

a valve for each pillow, said valves being operatively connected with the manifold for receiving pressurized fluid therefrom; and an inflation tube connecting each valve with a respective pillow, for selectively supplying said pillows with pressurized fluid under control of said valves, at least some of the inflation tubes being of a sufficient length to permit the positioning of pillows in supporting relation to a person's head and feet.

* * * * *